US008435602B1

(12) United States Patent
Seal

(10) Patent No.: US 8,435,602 B1
(45) Date of Patent: May 7, 2013

(54) LANTHANIDE DOPED NANOCRYSTALLINE CERIA COATING FOR INCREASING OXIDATION RESISTANCE OF STAINLESS STEEL AND ASSOCIATED METHODS

(75) Inventor: Sudipta Seal, Orlando, FL (US)

(73) Assignee: University of Central Florida Research Foundation, Inc., Orlando, FL (US)

( * ) Notice: Subject to any disclaimer, the term of this patent is extended or adjusted under 35 U.S.C. 154(b) by 287 days.

(21) Appl. No.: 12/329,083

(22) Filed: Dec. 5, 2008

Related U.S. Application Data

(60) Provisional application No. 60/992,337, filed on Dec. 5, 2007.

(51) Int. Cl.
*B05D 1/18* (2006.01)
*B05D 3/00* (2006.01)

(52) U.S. Cl.
USPC ..... 427/328; 427/327; 427/430.1

(58) Field of Classification Search ..... 427/327, 427/430.1
See application file for complete search history.

(56) References Cited

U.S. PATENT DOCUMENTS

| | | | | |
|---|---|---|---|---|
| 7,229,600 | B2 * | 6/2007 | Yadav | 423/263 |
| 2007/0141370 | A1 * | 6/2007 | Kerber | 428/469 |
| 2008/0210902 | A1 * | 9/2008 | Coy et al. | 252/182.33 |

OTHER PUBLICATIONS

Thanneeru et al. Effect of trivalent rare earth dopants in nanocrystalline ceria coatings for high temperature oxidation resistance. Acta Materialia. vol. 55, pp. 3457-3466. 2007.*
Patil et al.Nanocrystalline Ceria impart better high-temperature protection. Proc. R. Soc. Lond. A (2004) 460, 3569-3587.*
Sundararajan et al. High temperature corrosion of nanoceria coated 9Cr-1 Mo ferritic steel in air and stem. Surface & Coatings Technology. 201, pp. 2124-2130. 2006.*
Patil et al. Role of trivalent La and Nd dopants in lattice distortion and oxygen vacancy generation in cerium oxide nanoparticles. Applied Physics Letters. vol. 88, 243110. 2006.*
Session Information, NST I: NanoScience & Technology—I. http://metallurgy.iitm.ac.in/isrs/isrs06/sesxp.php?id=30. Doping Effect on Nanoceria Coatings for High Temperature Oxidation Resistance, ISRS Conference, IIT Madras, Chennai, India. (2006).*

* cited by examiner

*Primary Examiner* — David Turocy
(74) *Attorney, Agent, or Firm* — Allen, Dyer, Doppelt, Milbrath & Gilchrist, P.A.

(57) ABSTRACT

Disclosed is a method of applying to stainless steel a protective coating effective in increasing oxidation resistance, the method includes cleaning and pre-oxidizing in hot dry air, cooling and coating the cooled stainless steel with nanocrystalline ceria particles doped with a lanthanide metal. Cleaning may include ultrasound and optionally polishing. Cooling is conducted in air and coating is preferably effected by dipping the stainless steel into a composition containing the nanocrystalline ceria particles. The invention includes a coating effective for retarding oxidation of stainless steel, the coating comprising nanocrystalline ceria particles doped with a lanthanide, a preferred lanthanide being lanthanum and preferred nanocrystalline ceria particles are approximately 3 nm in size and contain from about 2 to 40 atom % of the dopant.

14 Claims, 7 Drawing Sheets

Figure 6a
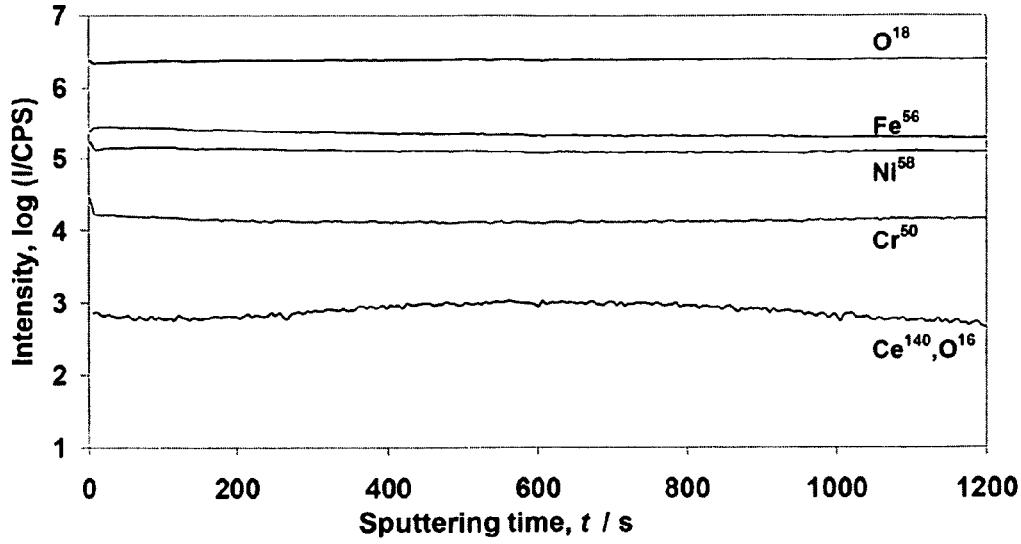
Figure 6b
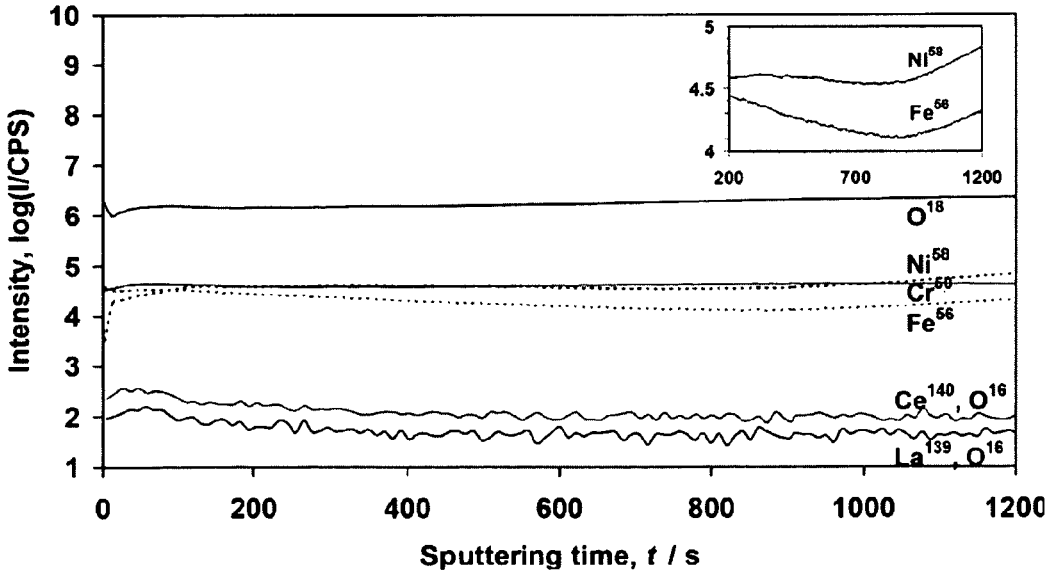
FIG. 6

LANTHANIDE DOPED NANOCRYSTALLINE CERIA COATING FOR INCREASING OXIDATION RESISTANCE OF STAINLESS STEEL AND ASSOCIATED METHODS

RELATED APPLICATION

This application claims priority from co-pending provisional application Ser. No. 60/992,337, which was filed on 5 Dec. 2007, and which is incorporated herein by reference in its entirety.

FIELD OF THE INVENTION

The present invention relates to the field of metal coatings and, more particularly, to a lanthanide-doped nanocrystalline ceria coating which increases the oxidation resistance of stainless steel, and associated methods.

BACKGROUND OF THE INVENTION

Nanoceria (NC) has been shown to possess unique properties from its large scale complement such as the shifting and broadening of Raman-allowed modes [1], lattice expansion [2,3] and blue shift in ultraviolet absorption spectra [4]. As a result of these unique properties, NC has potential applications in UV protection, catalysis [5-9], and high-temperature oxidation resistance. Recently, it has been reported that small additions of lanthanides may confer even greater protection on those metals and alloys that are already well protected from corrosion by oxide films [10]. These include iron-chromium and iron-chromium-nickel stainless steels (i.e., both ferritic and austenitic alloys) and most other alloys that are dependent on chromium for their corrosion/oxidation resistance. Many high-temperature alloys rely on the formation of protective Al2O3 and Cr2O3 scales on their surfaces to resist high-temperature oxidation [10-13]. However, under various isothermal and thermal cycling conditions, these protective coatings crack due to thermal stresses and grain growth.

Oxide scale cracking and spalling restrict the application of such alloys as high-temperature oxidation resistant materials under demanding service conditions [10]. Addition of rare earth elements such as Ce, Y, Zr, La or their oxides improve the high-temperature oxidation resistance of alumina-and chromia-forming alloys due to the reactive-element effect (REE) [14-19]. Due to the REE, the oxide scale growth rate decreases, with an improvement in resistance to scale spalling as a result of increased scale-alloy adhesion.

Various researchers have put forward mechanisms to explain the REE. Antill and Peakall [11] indicated that the beneficial effect of the rare earth elements was primarily to improve scale plasticity for accommodating stresses due to the difference in the thermal expansion coefficients between the alloy and the oxide scale. The enhancement of oxide nucleation processes through the presence of rare earth elements was suggested by Stringer [12]. Tien and Pettit [13] reported that the application of rare earth elements provide sites for vacancy condensation in an Fe-25Cr-4Al alloy with consequent improvement of scale adhesion. A mechanism involving the pegging of the oxide scale to the alloy substrate has also been suggested [20]. Duffy and Tasker [21] supported the model of grain boundary blocking by $Ce^{4+}$ ions, which associate with metal vacancies to form arrays of defect pairs along the grain boundaries. Moon and Bennett [22] concluded that the scale nucleates at the reactive-element oxide particles on the surface, blocks short-circuit diffusion paths by segregating reactive-element ions and reduces the stresses in the oxide scale by altering the microstructure.

It was first reported that ceria could be applied superficially rather than as an alloy addition and chromia growth could be slowed down in Ref. [23]. Earlier studies [24,25] indicated that superficial coating of micrometer-sized cerium oxide particles is effective in improving the high-temperature oxidation resistance of various grades of stainless steels (SS). Various researchers have carried out preliminary investigations on the improvement of the high-temperature oxidation resistance of Ni, Cr and Ni—Cr super alloys with the application of NC coatings [26,27]. It was also reported that NC coatings improve the high-temperature oxidation resistance of chromia forming steels [28]. However, detailed investigations into the effects of doped and undoped ceria nanoparticles and the role of oxygen vacancies in the improvement of high-temperature oxidation resistance of SS are yet to be carried out.

SUMMARY OF THE INVENTION

With the foregoing in mind, the present invention advantageously provides a method of increasing the oxidation resistance of stainless steel, particularly at high temperatures. The method calls for coating the stainless steel with nanocrystalline ceria particles containing a lanthanide dopant. In a preferred embodiment of the method the nanocrystalline ceria particles are approximately 3 nm. Coating of the steel is preferably, but not exclusively, effected by dipping the stainless steel into a composition containing the nanocrystalline ceria particles. Those skilled in the art of coatings will recognize that any effective coating technique may be employed to deposit a thin coating of the present inventive composition on the steel. Accordingly, although examples provided below are coated by dipping, this is not intended to be the only way of applying the coating to the steel. A preferred dopant is lanthanum and the nanocrystalline ceria particles contain from about 2 to about 40 atom % of the dopant, with oxidation resistance increasing with increasing dopant.

Another embodiment of the presently disclosed invention includes applying to stainless steel a protective coating effective in increasing oxidation resistance, with some additional steps. This embodiment calls for cleaning the stainless steel to obtain a surface substantially free of foreign matter. Pre-oxidizing the cleaned stainless steel in hot dry air is followed by cooling the pre-oxidized stainless steel. The method then calls for coating the cooled stainless steel with nanocrystalline ceria particles doped with a lanthanide metal. In this method, cleaning may comprise ultrasound and may further comprise polishing. In drying, the hot dry air preferably has a temperature of approximately 973 K. Pre-oxidizing is effected for a time sufficient to form a thin, adherent oxide layer on the stainless steel and cooling is conducted in air. As above, coating is preferably, but not exclusively, effected by dipping the stainless steel into a composition containing the nanocrystalline ceria particles.

The present invention additionally includes a coating effective for retarding oxidation of stainless steel, the coating comprising nanocrystalline ceria particles doped with a lanthanide. The coating composition may include a carrier fluid in which the nanocrystalline ceria particles are suspended. A preferred coating is made of nanocrystalline ceria particles which are approximately 3 nm in size. Additionally, the nanocrystalline ceria particles in the coating contain from about 2 to 40 atom % of the lanthanide dopant, which in a preferred embodiment is lanthanum.

BRIEF DESCRIPTION OF THE DRAWINGS

Some of the features, advantages, and benefits of the present invention having been stated, others will become apparent as the description proceeds when taken in conjunction with the accompanying drawings, presented for solely for exemplary purposes and not with intent to limit the invention thereto, and in which:

FIG. 6*a* provides SIMS depth profiles of Fe, Ni, Cr and O from the outer surface to the inner surface of oxide scale formed on the NC coated SS; and FIG. 6*b* shows SIMS depth profiles of Fe, Ni and Cr from the outer surface to the inner surface of oxide scale formed on the 20 LDN coated SS; the inset shows Fe and Ni depletion zones present in the oxide layer.

DETAILED DESCRIPTION OF THE PREFERRED EMBODIMENT

Figure 1:
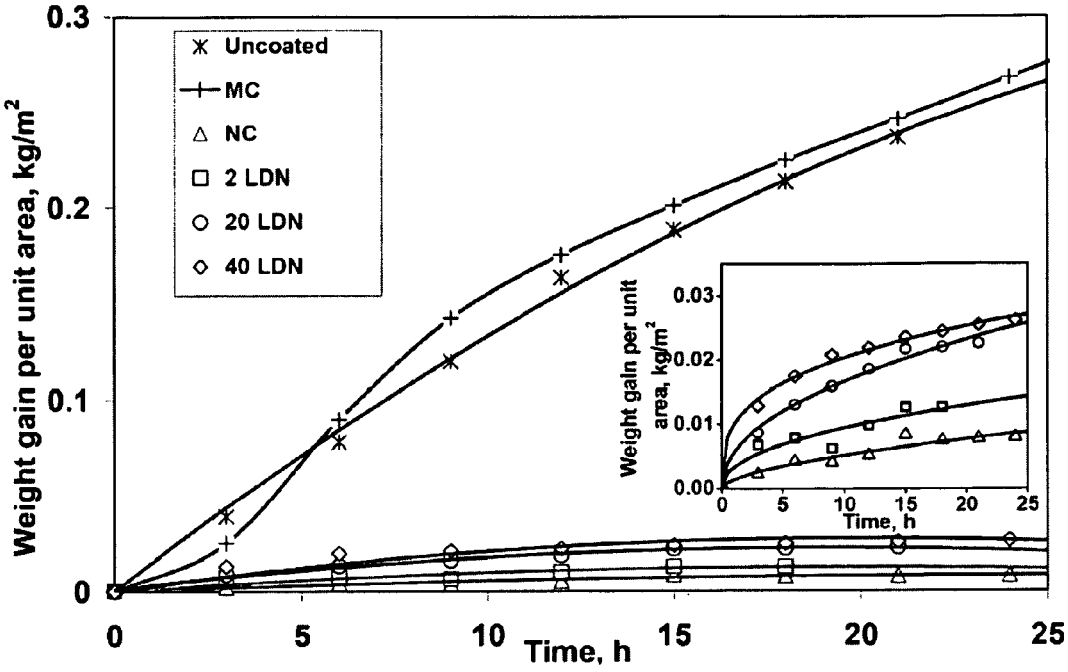
FIG. 1 shows weight gain per unit area, versus time plots for isothermal oxidation of AISI 304 SS at 1243 K in dry air for 24 hours.

The present invention will now be described more fully hereinafter with reference to the accompanying drawings, in which preferred embodiments of the invention are shown. Unless otherwise defined, all technical and scientific terms used herein have the same meaning as commonly understood by one of ordinary skill in the art to which this invention pertains. Although methods and materials similar or equivalent to those described herein can be used in the practice or testing of the present invention, suitable methods and materials are described below. Any publications, patent applications, patents, and other references mentioned herein are incorporated by reference in their entirety. In case of conflict, the present specification, including any definitions, will control. In addition, the materials, methods and examples given are illustrative in nature only and not intended to be limiting. Accordingly, this invention may be embodied in many different forms and should not be construed as limited to the illustrated embodiments set forth herein. Rather, these illustrated embodiments are provided so that this disclosure will be thorough and complete, and will fully convey the scope of the invention to those skilled in the art. Other features and advantages of the invention will be apparent from the following detailed description, and from the claims.

The present study investigates the effects of NC coatings on the isothermal oxidation resistance of AISI 304 SS at 1243 K in dry air. We have carried out a comparative study on the oxidation kinetics of AISI 304 SS for uncoated, MC, NC and LDN (NC doped with various amounts of $La^{3+}$-2 LDN, 20 LDN and 40 LDN, see Table 1) SS samples using detailed microstructural analysis by scanning electron microscopy (SEM), energy dispersive spectroscopy (EDS), X-ray diffraction (XRD) and secondary ion mass spectrometry (SIMS).

Experimental Method

Cerium oxide nanoparticles were synthesized by the micro-emulsion method. The micro-emulsion system consisted of sodium bis(2-ethylhexyl) sulphosuccinate (AOT) as a surfactant, water as a polar solvent and toluene as a non-polar solvent. The doped nanoparticles were synthesized using cerium nitrate and lanthanum nitrate as the precursors and ammonium hydroxide as the precipitating agent. All the chemicals were purchased from Aldrich Chemical Co. The amounts of cerium nitrate (99% purity) and lanthanum nitrate used to synthesize NC and LDN are shown in the Table 1. The details of the synthesis procedure have been described elsewhere [29].

AISI 304 grade SS samples with a thickness of 3 mm were used in the present study. The chemical composition (wt %) of the SS samples used in the present study is as follows: C, 0.05; Mn, 1.45; Si, 0.51; Cr, 17.9; Ni, 8.85; S, 0.015; P, 0.029; the balance being Fe. The SS substrates used were ~12.5×12.5 mm, with a small hole of diameter 1/16 in. drilled near an edge so as to hang the sample in the thermobalance. Specimens were polished using 1200 grit SiC polishing paper and cleaned ultrasonically in ethanol. It was reported that pre-oxidation of the substrate improves surface wetting and forms a thin, adherent oxide layer on the alloy surface [30]. Hence, the polished, cleaned SS specimens were pre-oxidized at 973K for 2 min in dry air, followed by cooling in air. The weight gain of the specimen due to such pre-oxidation treatment was found to be <0.01 mg. The samples were dip coated in doped and undoped ceria compositions; the same coating weight of $2\times10^{-3}$ g $cm^{-2}$ was used for all the specimens with a coating thickness of 600 nm.

The SS substrate and MC, NC and LDN coated samples were oxidized at 1243 K for 24 hin dry air. The oxidation kinetics were measured continuously in a thermogravimetric setup consisting of a microbalance (Sartorius, model LA230P, ±0.01 mg), a vertical furnace with temperature-controlling accessories and a computer for continuous data acquisition. The details of the high-temperature oxidation setup used in the present study were described previously [25,31]. Scale morphology of the oxidized samples coated with NC and 2, 20 and 40 LDN was studied using a JEOL T-300 SEM with an acceleration voltage of 5 kV. The elemental analysis of the oxide scale formed on the NC and 20 LDN samples was carried out using EDS. Cross-sectional SEM studies were carried out for the NC and 20 LDN samples. Both line profile and X-ray elemental scanning were carried out for elemental analysis across the oxide layer. XRD analyses of the top oxide layer on uncoated, NC and 20 LDN samples were carried out using a Rigaku analytical diffractometer with Cu Ka radiation (k=0.154056 nm). SIMS depth-profile analysis was carried out in order to map the distribution of the elements in the oxide scale formed on NC and 20 LDN samples using the Adept 1010 system from Physical Electronics Inc.

TABLE 1

Synthesis parameters of doped and undoped ceria solutions

| Sample | Amount of lanthanum doping (at. %) in ceria | Weight (g) in 5 ml distilled water $Ce(NO_3)_3 \cdot 6H_2O$ | $La(NO_3)_3 \cdot 6H_2O$ |
|---|---|---|---|
| NC | 0 | 0.2170 | — |
| 2 LDN | 2 | 0.2130 | $4.33 \times 10^{-3}$ |
| 20 LDN | 20 | 0.1736 | 0.0433 |
| 40 LDN | 40 | 0.1302 | 0.0866 |

TABLE 2

Parabolic rate constant ($k_p$) values for oxidation of uncoated and MC, NC and LDN coated samples at 1243 K in dry air for 24 h

| Sample | $k_p$ values ($kg^2m^{-4}s^{-1}$) |
|---|---|
| Uncoated | $1.50 \pm 0.01 \times 10^{-3}$ |
| MC | $1.80 \pm 0.02 \times 10^{-3}$ |
| NC | $6.25 \pm 0.05 \times 10^{-7}$ |
| 2 LDN | $6.40 \pm 0.05 \times 10^{-6}$ |
| 20 LDN | $2.00 \pm 0.02 \times 10^{-5}$ |
| 40 LDN | $2.26 \pm 0.02 \times 10^{-5}$ |

TABLE 3

Calculated oxygen vacancy concentrations in ceria doped by lanthanum

| Lanthanum-doped ceria | Oxygen vacancy concentration per lattice oxygen sites |
|---|---|
| 2 La Ceria ($Ce_{0.98}La_{0.02}O_{1.99}$) | 0.005 |
| 20 La Ceria ($Ce_{0.8}La_{0.2}O_{1.9}$) | 0.05 |
| 40 La Ceria ($Ce_{0.6}La_{0.4}O_{1.8}$) | 0.1 |

Results and Discussion

Oxidation Kinetics of 304 SS Coated with Doped and Undoped Ceria

FIG. 1 shows the oxidation kinetics plots of uncoated and MC, NC, 2 LDN, 20 LDN and 40 LDN coated AISI 304 grade SS samples at 1243 K in dry air for 24 h. The NC coated sample showed improvement in high-temperature oxidation resistance over the uncoated and MC coated samples. During the initial stages of oxidation in the bare alloy, a Cr2O3 layer forms on the top surface. After the formation of Cr2O3 as the top layer, subsequent oxidation was by slow diffusion of other alloy elements through the Cr2O3 layer, leading to a reduced rate of oxide scale growth in the later stages, but the protective chromia layer fails due to stresses and thermal-expansion-coefficient mismatch between the oxide scale and the substrate. This was observed in the uncoated and MC coated samples, where a steady weight gain was observed. Moreover, the chromia layer is prone to evaporation as $CrO_3$ species at high temperature [32]. However, when coated with LDN the weight gain was slightly increased as compared to the NC coated sample, as shown in the inset of FIG. 1. It is also evident that the weight gain per unit area increased with dopant concentration in the initial stages; however, the oxide scale was still protective following parabolic growth law kinetics. This indicates that large dopant concentrations reduce oxidation resistance compared to NC, but provide better protection than is seen in the SS and the MC samples. Thermogravimetric analysis showed a parabolic relationship with kinetics following the equation:

$$dw/dt = k_p/2w$$

where w is the weight gain per unit area of the sample (g/cm2) and $k_p$ is the parabolic oxidation rate constant ($g^2/cm^4$ s). Such a parabolic law introduces the fact that oxide growth is controlled by diffusion [33]. The $k_p$ values are reported in Table 2. The obtained kp values are representative of the formation of a $Cr_2O_3$ healing layer [34]. The $k_p$ values are reduced four orders of magnitude in the case of NC coating and the reduction is 2-3 orders of magnitude for LDN coatings compared to the uncoated sample.

The observed weight gains for the NC and doped ceria coated samples in the initial exposure were due to the inward diffusion of oxygen filling the oxygen vacancies created in the coatings [35]. At the same time, as the initial protective chromia layer forms, the thickness of the oxide layer increases with increasing oxygen availability. After the initial exposure, the weight gain in the NC and LDN samples remained constant, showing the protective nature of the coating. This shows that both doped and undoped ceria coated SS samples can be protected from high-temperature oxidation. Upon high-temperature oxidation, NC particles in the coating provide extra nucleation sites for chromia formation. Consequently, the surface below NC coatings is completely covered by chromia more rapidly [28]. Therefore, the early formation of protective chromia becomes more favored as the number of ceria particles on the surface is increased. Hence, it would enable NC coatingto provide faster and earlier formation of the chromia healing layer on the surface.

Morphological Characterization of the Top Oxide Scale

Figure 2:
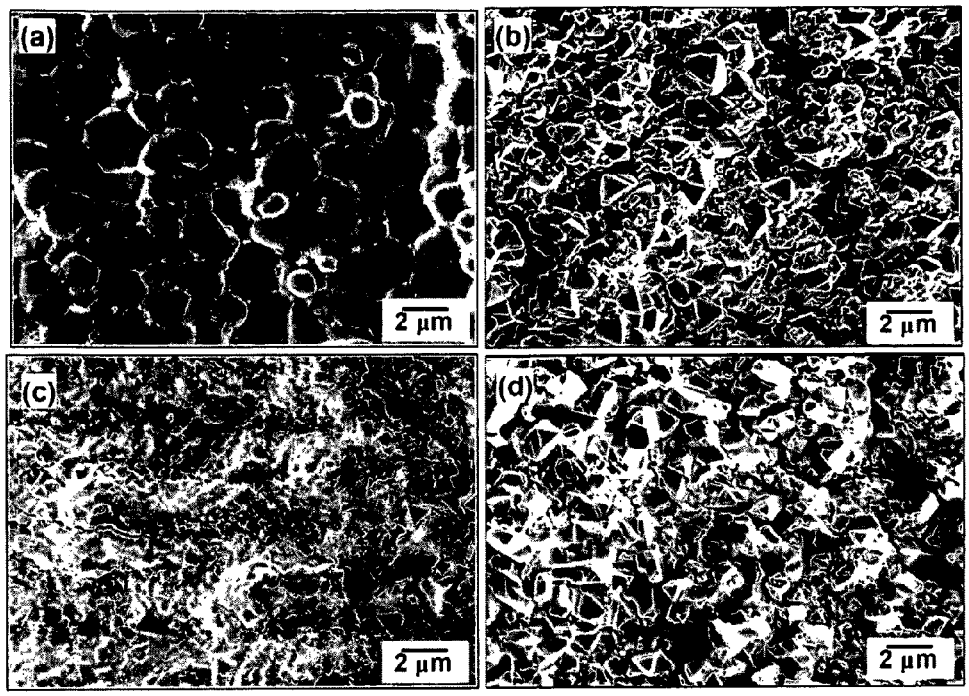
FIG. 2 presents four SEM photomicrographs at 5000× of top oxide scale formed on the: (a) 2 NC; (b) 2 LDN; (c) 20 LDN; and (d) 40 LDN SS at 1243 K.

The oxide scale formed on the NC sample is compact, whereas all LDN samples have a relatively faceted and porous structure as shown in FIG. 2. The amount of doping increases the number of nucleation sites and forms a fine-grained oxide layer on the surface. The formation of this fine-grained oxide layer in the case of LDN samples is due to heterogeneous nucleation [24] caused by the presence of defects in the coating, as shown in FIG. 2. The formation of fine-grained chromium oxide [36] on the surface of LDN samples shows that the diffusion of iron is restricted by segregation of doped ceria nanoparticles. The segregation of ceria at the grain boundaries, which is also prevalent in the doped ceria coated sample, prevents the outward diffusion of chromium but enhances inward oxygen diffusion. This is observed in FIG. 1, where weight gain per unit area is reduced >90% for NC and LDN samples as compared to uncoated and MC coated samples for isothermal oxidation at 1243 K in dry air for 24 h. In both NC and LDN samples, a marked improvement in spalling resistance under isothermal oxidation conditions is observed. The average porosity of oxide scale formed on NC, 2 LDN, 20 LDN and 40 LDN samples is 4.72±0/24%, 5.68±0/32%, 11.84±0.66% and 15.68±082%, respectively. Increasing the dopant concentration in NC coatings led to high porosity in the oxide scale formed on the steel sample.

Figure 3:
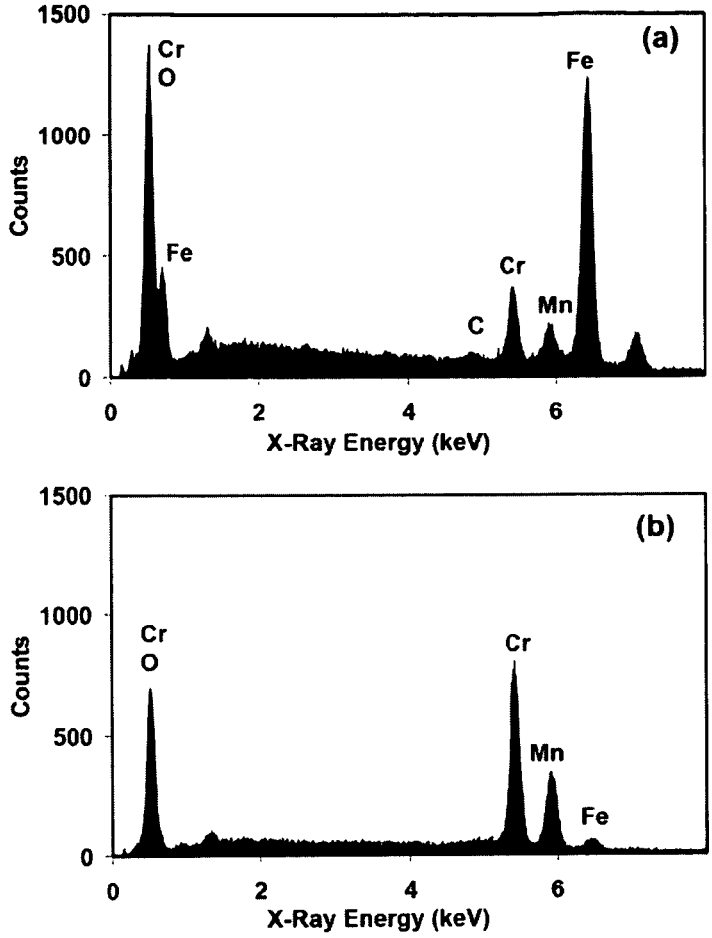
FIG. 3 shows the EDX spectra of the top oxide scale formed on NC (top graph) and 20 LDN (bottom graph) coated SS at 1243 K.

The EDS spectra of the top oxide scale of the 20 LDN sample showed more chromium in the surface oxide layer than the NC sample, as shown in FIG. 3. This increase in chromium is due to enhancement of chromium oxide formation assisted by the inward oxygen diffusion. It also indicates a relatively thicker oxide scale in the LDN samples. The fine-grained structure is clearly seen in the case of LDN samples and this increases the grain boundary area X-Ray Energy (keV) for diffusion of Fe and Cr through the initial healing chromia layer.

Cross-Sectional Morphology

Figure 4A:
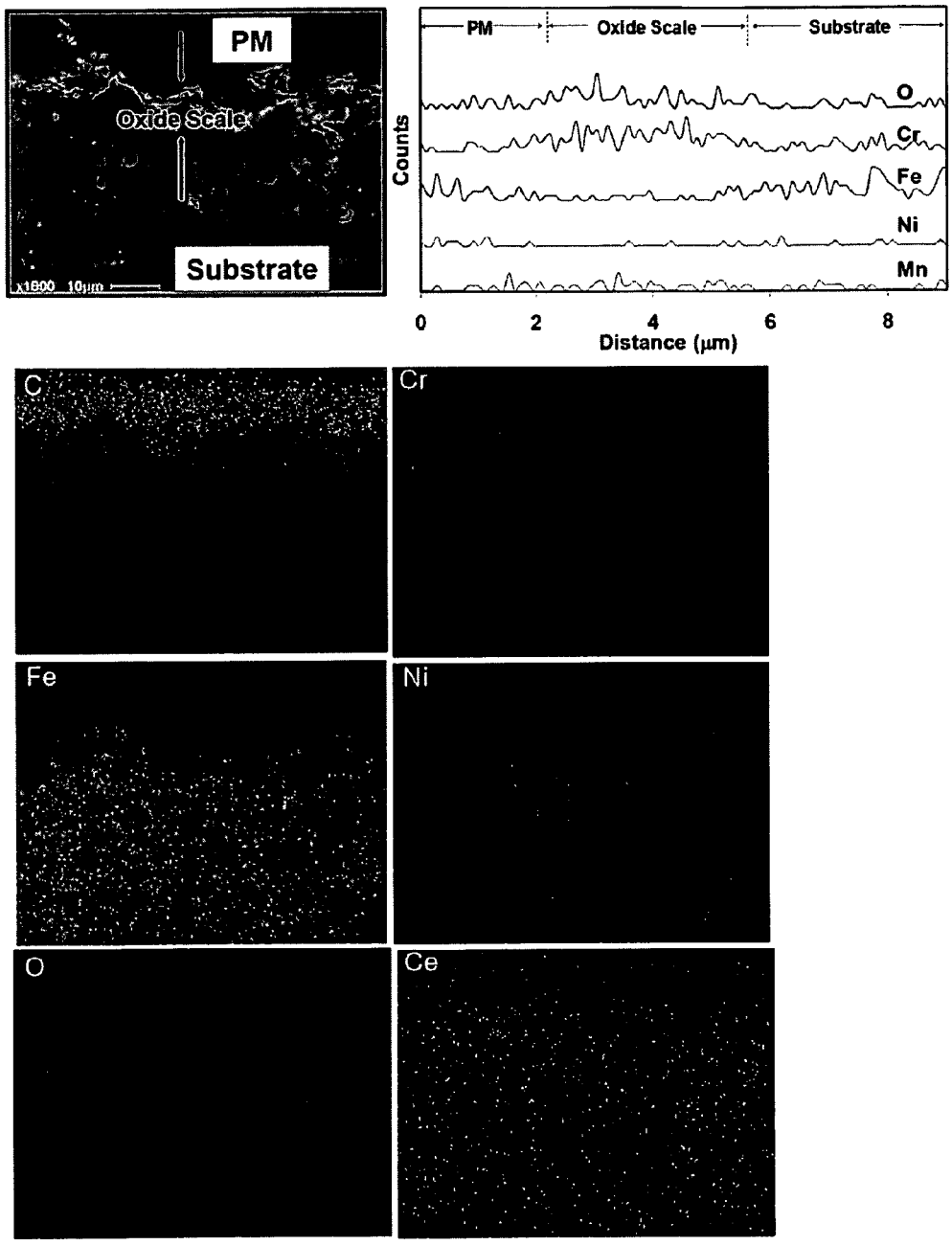
FIG. 4*a* shows SEM photomicrographs of the cross-section, line scanning and X-ray mapping of each element of SS samples coated with NC.
Figure 4B:
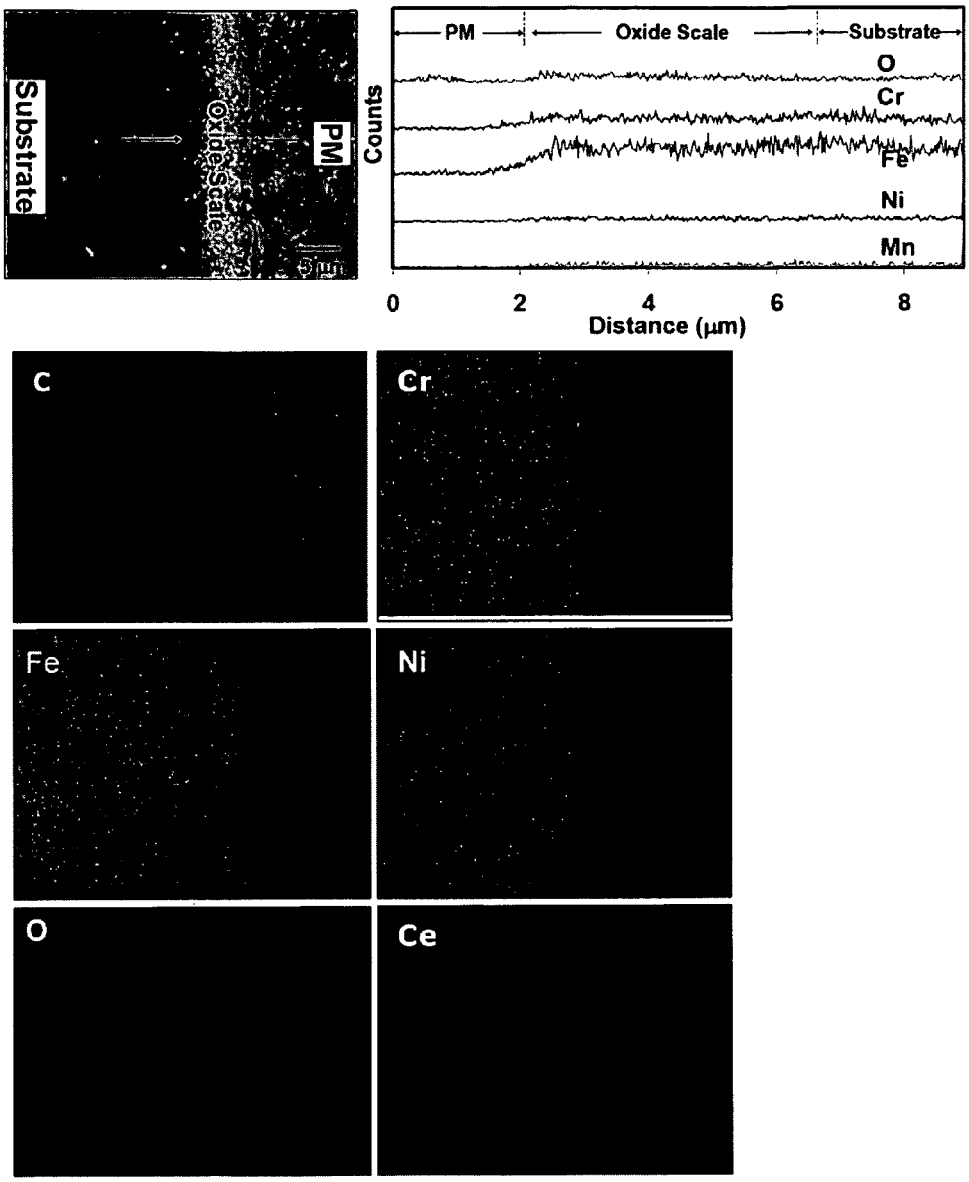
FIG. 4*b* shows SEM photomicrographs of the cross-section, line scanning and X-ray mapping of each element of SS samples coated with 20 LDN.

Cross-sections of NC and 20 LDN samples were analyzed by SEM for oxide layer thickness measurement and elemental mapping in the oxide scale. The oxide layer formed on NC sample was continuous and uniform, with a thickness of 3-4 μm, as shown in FIG. 4*a*. The scale formed on the 20 LDN sample was relatively discontinuous with a thickness of 6-8 μm. as shown in FIG. 4*b*. The oxide layer thickness of the uncoated sample was 30-35 μm and the thickness was reduced >70% for both doped and undoped ceria samples when oxidized at 1243 K in dry air for 24 h. This showed a marked improvement in the NC based oxidation resistant coatings. The line scanning of NC sample showed more counts for Cr and Mn and no counts for Fe in the oxide scale, as shown in FIG. 4*a*. This clearly indicates the presence of chromia in the oxide layer. X-ray mapping of the NC sample cross-section showed the presence of Cr in the oxide layer as shown in FIG. 4*a*. This indicates the formation of an impervious chromia layer, suppressing any diffusion of Fe outward, an important parameter for the development of oxidation resistant coatings. In the case of the 20 LDN sample, the counts for both iron and chromium were high in the oxide scale, as shown in FIG. 4*b*. X-ray mapping of the 20 LDN sample cross-section showed the presence of Cr and Fe and also small amounts of Ni in the oxide layer, as shown in FIG. 4*b*. This indicates the presence of both iron oxide and chromia in the oxide layer formed on the 20 LDN sample.

Identification of the Phases in the Oxide Layer

Figure 5:
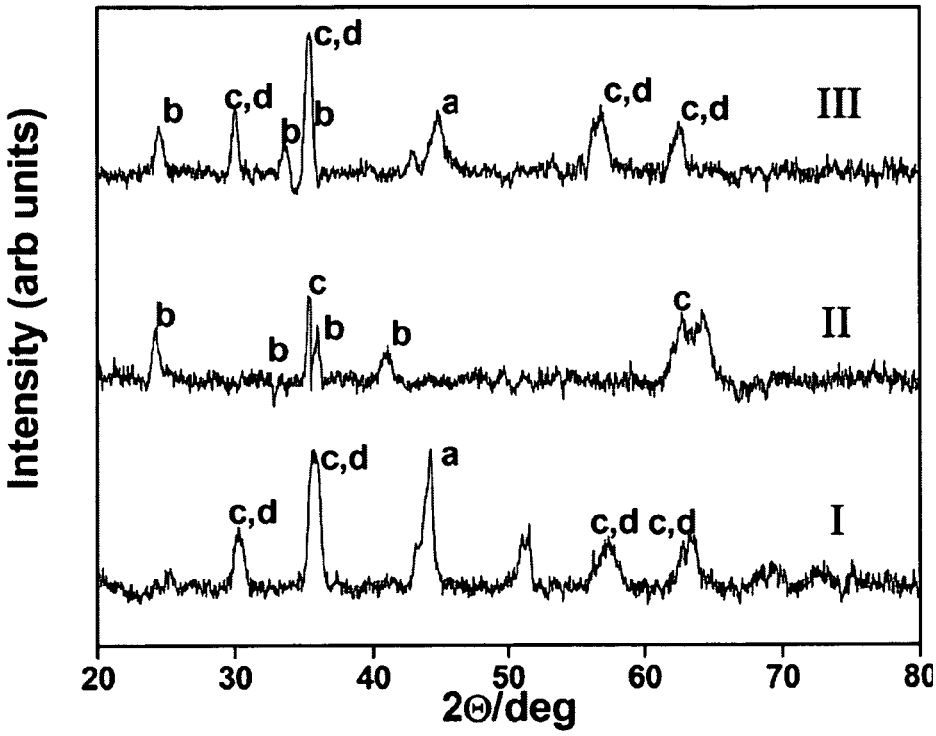
FIG. 5 depicts XRD spectra for SS surface (I) uncoated, (II) NC and (III) 20 LDN coated samples; peak identification is (a) Fe—Cr; (b) $Cr_2O_3$, (c) $Fe_3O_4$, and (d) $FeCr_2O_4$.

XRD was carried out on the uncoated and NC and 20 LDN coated samples in order to identify the phases present in the top surface of the sample, as shown in FIG. 5. XRD on the uncoated sample after spalling showed the presence of Fe—Cr, $Fe_3O$, and $FeCr_2O_4$. The presence of an Fe—Cr peak in the SS sample shows the spalling of the oxide layer due to the difference in the thermal expansion coefficients of the sample and the oxide scale. The absence of the Fe—Cr peak in the case of the NC sample shows that there is no spalling of the oxide layer. The presence of this Fe—Cr peak is depressed in the 20 LDN sample, indicating a porous structure of the oxide layer. The XRD data further support the SEM micrographs of the cross-section (FIG. 4), where the NC sample has a continuous, uniform oxide layer and the 20 LDN sample has a relatively porous oxide layer. The XRD pattern of the NC sample showed the primary presence of chromia and small amounts of iron oxide. The 20 LDN sample showed the presence of $Fe_3O_4$, $FeCr_2O_4$ spinel peaks and a less intense $Cr_2O_3$ peak. This shows the diffusion of Fe through the initial chromia layer and the formation of $Fe_3O_4$, $FeCr_2O_4$ spinels on top of the chromia layer. This may cause further degradation of the material by formation of voids at the interface between oxide scale and steel, resulting in poor scale adherence upon subjection to long-term thermal cycling. However, under the current conditions, no spalling of the oxide layer in the doped ceria samples was observed. This indicates that the diffusion of Fe through the chromium oxide was still minimal as compared to the SS and MC samples. To understand the diffusion kinetics, SIMS analysis was carried out on the oxide scales.

Kinetics and Thermodynamic Aspects of Oxide Scale Formation

In order to investigate the distribution of various alloying elements across the oxide scale, SIMS depth-profiling was carried out on the NC and 20 LDN samples. FIGS. 6*a* and 6*b* show the SIMS depth profiles of Fe, Cr, Ni and O in the oxide scale formed on the NC and 20 LDN samples.

The formation of oxides at the surface of steel samples depends on both diffusion species (Fe, Cr, etc.) from the steel and oxygen supply to the interface. The diffusion of metal atoms towards the metal/oxide interface increases with increasing temperature, while the supply of oxygen towards the gas/oxide interface increases with increasing oxygen vacancies present in the nanostructured coatings. Therefore, depending on oxidation temperature and oxygen availability, different oxide phases will form. The important feature of oxide formation is the existence of a critical pressure ($P'_c$) of oxygen at specific oxidation temperature, where the supplies of metal and oxygen to the interface are of an equal order of magnitude. It has been observed that at a given temperature, a critical oxygen partial pressure is required for the formation of a chromia enriched oxide layer [37].

At any temperature, if the number of metal atoms diffusing into the initial chromia layer is equal to the number of oxygen atoms available per unit time, then the corresponding metal oxide can form. Thermodynamics plays an important role in explaining the formation of oxides under conditions of limited oxygen availability. The calculated free energy changes for $Cr_2O_3$, MnO, $SiO_2$, FeO, $Fe_3O$, and NiO are, respectively, —528.7, −588.5, −657.85, −367.4, −360 and −257.4 kJ for 1 mole of oxygen to react with a metal to form its oxide at 1243 K. The negative values of DG0 show that formation of all these oxides is feasible at 1243 K, but, formation of $SiO_2$, MnO and chromia are predominant when the supply of oxygen is limited. This indicates that when there are fewer oxygen vacancies, chromia only is preferentially formed. However, when oxygen vacancies are increased with $La^{3+}$ doping, more oxygen atoms are available than the number of chromium atoms diffusing outward. All oxygen will react with chromium, which has a higher free energy of oxide formation than iron [38]. Thus, more of the mobile iron [39] will segregate at the interface to react with oxygen during further oxidation. Hence, the film becomes more enriched in iron, leaving an iron depletion zone. Similar results were observed when SS was oxidized at different partial pressures of oxygen, where at lower oxygen partial pressures only chromia forms and at higher partial pressures both chromia and iron oxides form [37].

The oxidation of SS at high temperatures results in the rapid formation of the oxide film, mostly leading to a chromium depletion zone next to the oxide film because of a limited supply of chromium from the bulk alloy to its surface region. In that case, diffusion in the bulk alloy becomes the rate-limiting step for the growth of the oxide film. The depth profile of chromium in the NC sample did not reveal any depletion region near the metal/oxide interface, suggesting that the diffusion of chromium through the grain boundaries of the initial oxide layer is less than or equal to the diffusion of chromium in the underlying metal. So the diffusion of chromium, not in the bulk alloy but in the natural oxide layer, was the rate-limiting step for oxide growth in the NC sample. Then, the growth rate of an oxide film is primarily controlled by the diffusion rate of chromium in the oxide layer as long as sufficient oxygen is available.

The depth profile shown in FIG. 6*a* exhibits higher counts of Cr in the oxide layer, which shows a gradual decrease in the chromium counts in this region, indicating the formation of a chromia layer on the surface. There is no change in the iron counts in this region, showing no diffusion of Fe through the initial chromia layer formed. The constant counts of Fe, Cr and Ni after the gradual decrease in counts of these elements shows that the diffusion of these atoms is sufficiently rapid in the underlying metal. The variations in the concentrations of iron, nickel and chromium indicate that there is no depletion of these elements inside the steel sample. This indicates that there is no void formation in the case of the NC sample. It also shows that the sample is well protected after oxidizing in dry air for 24 h and can be subjected to further thermal cycles.

The diffusion coefficient D has been estimated by considering the concentration profiles of iron, chromium and nickel measured by SIMS with respect to the solution of Fick's law [40]. The concentration profile C(x,t) depends on the diffusion depth x and the annealing time t. The sputtering times in FIGS. 6*a* and 6*b* are converted to depth x, as diffusion depth is a product of rate of sputtering and sputtering time. The rate of sputtering used in these calculations is 0.666 nm/s.

The diffusion is based on Fick's law:

$$\frac{\partial C(x,t)}{\partial t} = D\frac{\partial^2 C(x,t)}{\partial x^2}$$

The shallow part of the profile can be well fitted by solution of Fick's second law:

$$C(z,t) - C_0 = (C_s - C_0)\left[1 - \mathrm{erf}\left(\frac{z}{2\sqrt{D_{bulk}t}}\right)\right]$$

From the concentration profiles of Fe, Ni and Cr with the sputtering time shown in FIG. 6*a* for the NC sample annealed at 1243 K in dry air for 24 h, the diffusivities of the elements were calculated by fitting the depth profiles into the solution of Fick's second law. The calculated diffusivity values for Ni, Fe and Cr were $8.76\times10^{-19}$, $5.60\times10^{-15}$ and $7.73\times10^{-16}$ $cm^2 s^{-1}$, respectively. The low value of Ni diffusivity can also be observed in FIG. 6*a*, where there is much less variation of nickel concentration in the oxide layer. The depth profile shown in FIG. 6*b* exhibits higher counts of chromium compared to iron, indicating that conditions are more favorable for the formation of chromia on the surface than that of iron oxide. It also shows an initial increase in chromium counts on the top of the oxide followed by constant numbers of counts, indicating the formation of chromia in top oxide scale. There is not much variation of chromium concentration up to 1 μm depth, indicating that the diffusion of chromium is fast enough in the underlying metal. Thereisa gradual decreasein concentration of iron and nickel, showing the depletion zones of Fe and Ni (FIG. 6*b*, inset). This shows that the diffusion of iron and nickel is much less in the underlying metal because of the formation of the impervious chromia layer.

From the concentration profiles of Fe, Ni and Cr with depth shown in FIG. 6*b* for the 20 LDN sample annealed at 1243 K in dry air for 24 h, the diffusivities of the elements were calculated. The calculated diffusivity values for Ni, Fe and Cr were, respectively, $1.60\times10^{-16}$, $2.47\times10^{-15}$ and $1.95\times10^{-16}$ $cm^2 s^{-1}$.

In brief, chromium-rich oxide films grew below the NC coating as oxidation continued, but the composition of the oxide film was significantly changed by increasing the dopant concentration in the coating. As the diffusion rates depend exponentially on temperature, there exists a critical number of oxygen vacancies at which the supply of oxygen slightly exceeds the diffusion of chromium. Therefore, as the number of oxygen vacancies increases with the increase of dopant concentration, the formation of oxides other than chromia is also possible. The presence of Fe and Ni depletion zones in the case of 20 LDN indicates that the bulk diffusivities and diffusivities of these atoms in the oxide layer or coating differ.

Role of Dopants and Oxygen Vacancies in Oxidation Resistant Nanoceria-Based Coatings The lattice constant and oxygen vacancies increase with increasing amounts of trivalent elements such as La, Nd, etc. [41]. The lattice expansion slope for trivalent ions doped in ceria is 0.3 for $La^{3+}$ ions [42]. Oxygen vacancies are created for replacement of each two Ce4+ sites by two $La^{3+}$ ions to maintain electrostatic charge neutrality. The addition of La3+ ions to CeO2 results in solid solutions of the form $Ce_{1-x}La_xO_{2-y}$, that have the same fluorite structure as of $CeO_2$.

In $CeO_{2-x}$, loss of oxygen results in the generation of oxygen vacancies, which are compensated by generation of electrons. This reaction can be represented using the Kroger-Vink notation as:

$$2Ce^x_{Ce}+O^x_O=2Ce'_{Ce}+V_O+\tfrac{1}{2}O_2(gas)$$

The oxygen vacancy concentration of an oxide of type $MO_{2-x}$ is equal to half of its deviation from stoichiometry (x):

$$N_{v,O}/N_0=[V_O]=x/2$$

At high temperatures, diffusion of oxygen inward through the oxygen vacancies present in the ceria and doped ceria coatings determines the rate of initial oxidation. The availability of excess oxygen also enables further oxidation of Fe and Ni to form their oxides. As the oxygen vacancies increase with dopant concentration, as shown in Table 3, the available oxygen increases with the increase of dopant concentration in the coatings at high temperatures.

The formation of a ceria-lanthana solid solution caused by dissolution of the $La^{3+}$ ions into the $CeO_2$ lattice increases the lattice constant of lanthanum doped ceria because the radius of $La^{3+}$ ion (1.19 Å) is larger than that of the $Ce^{4+}$ ion (1.09 Å) [43]. Since LDN contains more oxygen vacancies, the nucleation sites for chromia formation increase with increasing dopant concentration. This leads to faster formation of the initial protective chromia layer at the metal/coating interface, but also increases the grain boundary area of the chromia layer. The segregation of NC and LDN at the grain boundaries of the chromia layer restricts the outward diffusion of chromium and enhances inward diffusion of oxygen [44]. This can be seen from the oxidation kinetics plots (FIG. 1), where a reduction of >90% weight gain in doped and undopedceria samples compared to SS and MC coated sample can be seen.

The formation of the initial protective chromia layer on the surface of SS controls the rate of oxidation by outward diffusion of chromium through the grain boundary of the chromia layer [45]. The presence of grain boundary segregation is supportive of the hypothesis of blocking grain boundary transport by reactive element addition. This hypothesis assumes that large $Ce^{4+}$ cations (ionic radius of 0.92 Å) form pairs with metal vacancies in oxide grain boundaries. The presence of dense arrays of such pairs inhibits metal cation diffusion, while allowing oxygen ion diffusion to continue. As a result, the change in the dominant oxide growth mechanism takes place from outward metal to inward oxygen diffusion and the oxidation rate diminishes by 1-2 orders of magnitude. The presence of NC has a significant grain boundary segregation effect on the chromia layer formed and is protective at high temperatures. As the dopant concentration increases, the ease of chromia formation increases as well. This indicates more weight gain in the primary stage of oxidation (FIG. 1). Increasing dopant concentration further refines the grains as is evident from FIG. 2.

The oxide scale growth mechanism in the cerium oxide particles is due to inward $O_2$ migration by the segregation of NC particles into the oxide grain boundaries and by blocking the outward diffusion of cations. Such a segregation effect in the case of NC is probably not only easier in terms of energetics, but also faster than that of the micrometer-sized particles. The present nanocrystalline particles, being approximately 3 nm in size, can cover the substrate more uniformly and segregate $Ce^{4+}$ ions into the grain boundaries more easily, causing effective blockage of the outward migration of cation, thereby retarding the oxide scale growth rate of AISI 304 SS at 1243 K in dry air.

CONCLUSIONS

The high-temperature oxidation kinetics of 304 steels has been studied in the presence of NC and LDN coatings. The weight gain per unit area of NC and LDN coatings is reduced significantly (2-4 orders of magnitude decrease in Kp) as compared to uncoated and MC coatings. SEM micrographs of the top oxide layer showed finer grain structure with increased porosity as the La concentration was increased in LDN coatings. XRD of the oxide scales shows a protective chromia layer in nanoceria coated steels. SIMS analysis on the NC sample showed the absence of depletion zones, indicating no void formation and, consequently, better oxidation resistance at high temperatures.

Accordingly, in the drawings and specification there have been disclosed typical preferred embodiments of the invention and although specific terms may have been employed, the terms are used in a descriptive sense only and not for purposes of limitation. The invention has been described in considerable detail with specific reference to these illustrated embodiments. It will be apparent, however, that various modifications and changes can be made within the spirit and scope of the invention as described in the foregoing specification and as defined in the appended claims.

REFERENCES

[1] Spanier J E, Robinson R D, Zheng F, Chan S W, Herman I P. Size-dependent properties of $CeO_{2-y}$ nanoparticles as studied by Raman scattering. *Phys. Rev. B* 2001:64.

[2] Tsunekawa S, Sivamohan R, Ito S, Kasuya A, Fukuda T. Structural study on monosize $CeO_{2-x}$ nano-particles. *Nanostruct Mater* 1999; 11:141.

[3] Zhang F, Chan S W, Spanier J E, Apak E, Jin Q, Robinson R D, et al. Cerium oxide nanoparticles: size-selective formation and structure analysis. *Appl Phys Lett* 2002; 80:127.

[4] Tsunekawa S, Sivamohan R, Ohsuna T, Kasuya A, Takahashi H, Tohji K. Ultraviolet absorption spectra of $CeO_2$ nano-particles. Rare Earths '98 1999; 315-3:439.

[5] Aneggi E, Boaro M, Leitenburg Cd, Dolcetti G, Trovarelli A. Insights into the redox properties of ceria-based oxides and their implications in catalysis. *J Alloys Compd* 2006; 408-412:1096.

[6] Demoulin O, Navez M, Mugabo J L, Ruiz P. The oxidizing role of $CO_2$ at mild temperature on ceria-based catalysts. *Appl Catal B: Environ* 2007; 70:284.

[7] Nolan M, Fearon J E, Watson G W. Oxygen vacancy formation and migration in ceria. *Solid State Ionics* 2006; 177:3069.

[8] Nolan M, Parker S C, Watson G W. The electronic structure of oxygen vacancy defects at the low index surfaces of ceria. *Surf Sci* 2005; 595:223.

[9] Trovarelli A, Boaro M, Rocchini E, de Leitenburg C, Dolcetti G. Some recent developments in the characterization of ceria-based catalysts. *J Alloys Compd* 2001; 323-324:584.

[10] Stringer J. The reactive element effect in high-temperature corrosion. *Mater Sci Eng A* 1989; 120:129.

[11] Antill J, Peakall K. Influence of an alloy addition of yttrium on the oxidation behavior of an austenitic and a ferritic SS in carbon dioxide. *J Iron Steel Inst* 1967; 205: 1136.

[12] Stringer J, Wallwork G R, Wilcox B A, Hed A Z. Effect of a thoria dispersion on high-temperature oxidation of chromium. *Corros Sci* 1972; 12:625.

[13] Tien J K, Pettit F S. Mechanism of oxide adherence on Fe-25Cr-4Al (Y or Sc) alloys. *Metall Trans* 1972; 3:1587.

[14] Cocking J L, Sprague J A, Reed J R. Oxidation behaviour of ion-implanted NiCrAl. *Surf Coat Technol* 1988; 36:133.

[15] George P J, Bennett M J, Bishop H E, Cotell C M, Garratt-Reed A J. Secondary ion mass spectrometry and scanning transmission and transmission electron microscopy studies of the effects of reactive elements on nickel oxidation. *Surf Coat Technol* 1992; 51:45.

[16] George P J, Bennett M J, Bishop H E, Dearnaley G. The effects of ion implantation upon nickel oxidation investigated by secondary ion mass spectrometry. *Mater Sci Eng A* 1989; 116:111.

[17] Paul A, Elmrabet S, Odriozola J A. Low cost rare earth elements deposition method for enhancing the oxidation resistance at high temperature of $Cr_2O_3$ and $Al_2O_3$ forming alloys. *J Alloys Compd* 2001; 323-324:70.

[18] Wei F I, Stott F H. The development of $Cr_2O_3$ scales on iron-chromium alloys containing reactive elements. Corros Sci 1989; 29:839.

[19] Yu X Q, Sun Y S. The oxidation improvement of $Fe_3Al$ based alloy with cerium addition at temperature above 1000° C. *Mater Sci Eng A* 2003; 363:30.

[20] Giggins C S, Kear B H, Pettit F S, Tien J K. Factors affecting adhesion of oxide scales on alloys. *Metall Trans* 1974; 5:1685.

[21] Duffy D M, Tasker P W. Theoretical-studies of diffusion-processes down coincident tilt boundaries in *Nio. Philos Mag A* 1986; 54:759.

[22] Moon D P, Bennett M J. The effects of reactive element oxide coatings on the oxidation behavior of metals and alloys at high temperature. *Mater Sci Forum* 1989; 43:269.

[23] Ecer G M, Singh R B, Meier G H. The Influence of Superficially applied oxide powders on the high-temperature oxidation behavior of $Cr_2O_3$-forming alloys. *Oxid Met* 1982; 18:55.

[24] Seal S, Bose S K, Roy S K. Improvement in the oxidation behavior of austenitic Stainless-Steels by superficially applied, cerium oxide coatings. *Oxid Met* 1994; 41:139.

[25] Seal S, Roy S K, Bose S K, Kuiry S C. Ceria based high temperature coatings for oxidation prevention. *J Mater* 2000; 52:1.

[26] Czerwinski F, Smeltzer W W. The growth and structure of thin oxide-films on ceria-sol-coated nickel. *Oxid Met* 1993; 40:503.

[27] Czerwinski F, Szpunar J A. The nanocrystalline ceria sol-gel coatings for high temperature applications. *J Sol-Gel Sci Technol* 1997; 9:103.

[28] Patil S, Kuiry S C, Seal S. Nanocrystalline ceria imparts better high-temperature protection. *Proc Roy Soc Lond Ser A* 2004; 460:3569.

[29] Patil S, Kuiry S C, Seal S, Vanfleet R. Synthesis of nanocrystalline ceria particles for high temperature oxidation resistant coating. *J Nanoparticle Res* 2002; 4:433.

[30] Czerwinski F, Szpunar J A. Optimizing properties of $CeO_2$ sol-gel coatings for protection of metallic substrates against high temperature oxidation. *Thin Solid Films* 1996; 289:213.

[31] Seal S, Kuiry S C, Bracho L A. Studies on the surface chemistry of oxide films formed on IN-738LC superalloy at elevated temperatures in dry air. *Oxid Met* 2001; 56:583.

[32] Tedmon C S. Effect of oxide volatilization on oxidation kinetics of Cr and Fe—Cr alloys. *J Electrochem Soc* 1966; 113:766.

[33] Huntz A M. Diffusion in growing oxide scale. *J Phys III* 1995; 5: 1729.

[34] Atkinson A. Transport processes during the growth of oxide films at elevated temperature. *Rev Mod Phys* 1985; 57:437.

[35] Saraf L, Shuttanandan V, Wang C, Zhang Y, Marina O, Thevuthasan S. Oxygen diffusion in nanocrystals in $CeO_2$. *IEEE* 2003.

[36] Sabioni A C S, Huntz A, da Luz E C, Mantel M, Haut C. Comparative study of high temperature oxidation behavior in AISI 304 and AISI 439 stainless steels. *Mater Res* 2003; 6:179.

[37] Cho B, Moon S, Chung S. Characterization of diffusion properties of chromium in stainless-steel oxides by photoemission spectroscopy. *J Vac Sci Technol A* 1991; 3:19.

[38] Lince J R, Didziulis S V, Shuh D K, Durbin T D, Yarmoff J A. Interaction of $O_2$ with the Fe0.84Cr0.16(001) surface studied by photoelectron-spectroscopy. *Surf Sci* 1992; 277: 43.

[39] Allen G C, Dyke J M, Harris S J, Morris A. A surface study of the oxidation of Type-304I Stainless-Steel at 600-K in air. *Oxid Met* 1988; 29:391.

[40] Sakai N, Yamaji K, Horita T, Negishi H, Yokokawa H. Chromium diffusion in lanthanum chromites. *Solid State Ionics* 2000; 135:469.

[41] Patil S, Seal S. Guo Y, Schulte A, Norwood J. Role of trivalent La and Nd dopants in lattice distortion and oxygen vacancy generation in cerium oxide nanoparticles. *Appl Phys Lett* 2006:88.

[42] McBride J R, Hass K C, Poindexter B D, Weber W H. Raman and X-ray studies of Ce1-Xrexo2-Y, Where Re—La, Pr, Nd, Eu, Gd, and Tb. *J Appl Phys* 1994; 76:2435.

[43] Sun K, Lu W, Wang M. Xianlunxu. Characterization and catalytic performances of La doped Pd/$CeO_2$ catalysts for methanol decomposition. *Appl Catal A* 2004; 268:107.

[44] Papaiacovou P, Hussey R J, Mitchell D F, Graham M J. The effect of $CeO_2$ coatings on the oxidation behaviour of $Fe^{-2}$0Cr alloys in $O_2$ at 1173 K. *Corros Sci* 1990; 30:451.

[45] Peng X, Yan J. Zhou Y, Wang F. Effect of grain refinement on the resistance of 304 stainless steel to breakaway oxidation in wet air. *Acta Mater* 2005; 53:5079.

That which is claimed:

1. A method of increasing the high temperature oxidation resistance of stainless steel, the method comprising coating the stainless steel with a lanthanum doped nanocrystalline ceria particle coating containing from 2 to 40 atom % of a lanthanum dopant and heating the coated stainless steel to form a protective oxide scale on the stainless steel at a higher rate relative to a protective oxide scale formed on the same type of stainless steel coated with an undoped nanocrystalline ceria particle coating containing ceria particles of the same size and heated under the same conditions.

2. The method of claim 1, wherein the nanocrystalline ceria particles are approximately 3 nm.

3. The method of claim 1, wherein coating is effected by dipping the stainless steel into a composition containing the nanocrystalline ceria particles.

4. A method of applying to stainless steel a protective coating effective in increasing oxidation resistance, the method comprising:

cleaning the stainless steel to obtain a surface substantially free of foreign matter;

pre-oxidizing the cleaned stainless steel in hot dry air;

cooling the pre-oxidized stainless steel;

coating the cooled stainless steel with nanocrystalline ceria particles doped with 2 to 40 atom % of lanthanum, the coating being sufficient to form a protective oxide scale on the stainless steel at a higher rate relative to a protective oxide scale formed on the same type of stainless steel coated with an undoped nanocrystalline ceria particle coating containing ceria particles of the same size and when heated under the same conditions.

5. The method of claim 4, wherein cleaning comprises ultrasound.

6. The method of claim 4, wherein cleaning comprises an alcohol.

7. The method of claim 4, further comprising polishing after cleaning.

8. The method of claim 4, wherein the hot dry air has a temperature of approximately 973 K.

9. The method of claim 4, wherein pre-oxidizing is effected for a time sufficient to form a thin, adherent oxide layer on the stainless steel.

10. The method of claim 4, wherein cooling is conducted in air.

11. The method of claim 4, wherein coating is effected by dipping the stainless steel into a composition containing the nanocrystalline ceria particles.

12. A coating effective for retarding oxidation of stainless steel, the coating comprising nanocrystalline ceria particles doped with 2 to 40 atom % of lanthanum, the coating being sufficient to form a protective oxide scale on the stainless steel at a higher rate relative to a protective oxide scale formed on the same type of stainless steel coated with an undoped nanocrystalline ceria particle coating containing ceria particles of the same size and when heated under the same conditions.

13. The coating of claim 12, further comprising a carrier fluid in which said nanocrystalline ceria particles are suspended.

14. The coating of claim 12, wherein the nanocrystalline ceria particles are approximately 3 nm in size.

* * * * *